US008605018B2

(12) United States Patent
Lee et al.

(10) Patent No.: US 8,605,018 B2
(45) Date of Patent: Dec. 10, 2013

(54) LIQUID CRYSTAL DISPLAY APPARATUS AND METHOD OF DRIVING THE SAME

(75) Inventors: Bong-Jun Lee, Seoul (KR); Jong-Hwan Lee, Anyang-si (KR); Yu-Jin Kim, Asan-si (KR)

(73) Assignee: Samsung Display Co., Ltd., Yongin (KR)

( * ) Notice: Subject to any disclaimer, the term of this patent is extended or adjusted under 35 U.S.C. 154(b) by 650 days.

(21) Appl. No.: 12/917,018

(22) Filed: Nov. 1, 2010

(65) Prior Publication Data

US 2011/0175858 A1 Jul. 21, 2011

(30) Foreign Application Priority Data

Jan. 20, 2010 (KR) ..... 10-2010-0005197

(51) Int. Cl.
*G09G 3/36* (2006.01)

(52) U.S. Cl.
USPC ..... 345/88; 345/204; 345/212

(58) Field of Classification Search
USPC ..... 345/87–100, 204–215, 690
See application file for complete search history.

(56) References Cited

U.S. PATENT DOCUMENTS

2011/0102403 A1* 5/2011 Kim ..... 345/211
2011/0254826 A1* 10/2011 Umezaki ..... 345/212

* cited by examiner

*Primary Examiner* — Vijay Shankar
(74) *Attorney, Agent, or Firm* — H.C. Park & Associates, PLC

(57) ABSTRACT

In a liquid crystal display apparatus, a first control signal bus line receives a first control signal. A second control signal bus line receives a second control signal that lags behind the first control signal. A de-multiplexer circuit includes a first switching element and a second switching element. The first switching element switches a current path between a first source line and a first data line in response to the first control signal, and the second switching element switches a current path between the first source line and a second data line in response to the second control signal. A pixel part includes a first pixel connected to the first control signal bus line and corresponding to a first color filter, a second pixel connected to the second control signal bus line and corresponding to a second color filter, and a third pixel corresponding to a third color filter, wherein the third pixels are alternately connected to the first control signal bus line and the second control signal bus line.

14 Claims, 4 Drawing Sheets

LIQUID CRYSTAL DISPLAY APPARATUS AND METHOD OF DRIVING THE SAME

CROSS REFERENCE TO RELATED APPLICATION

This application claims priority from and the benefit of Korean Patent Application No. 2010-5197, filed on Jan. 20, 2010, which is hereby incorporated by reference for all purposes as if fully set forth herein.

BACKGROUND OF THE INVENTION

1. Field of the Invention

Exemplary embodiments of the present invention relate to a liquid crystal display (LCD) apparatus and a method of driving the LCD apparatus. More particularly, exemplary embodiments of the present invention relate to an LCD apparatus in which a chip size is reduced and display quality is enhanced and to a method of driving the LCD apparatus.

2. Discussion of the Background

A liquid crystal display (LCD) apparatus controls light transmission by liquid crystals in accordance with a video signal to display an image corresponding to the video signal. The LCD apparatus includes an LCD panel in which liquid crystal cells are arranged in a matrix shape and a plurality of driving circuits for driving the LCD panel. A plurality of data lines and a plurality of gate lines cross each other on the LCD panel. A thin-film transistor (TFT) for driving a pixel of the LCD is formed at a crossing area of the data line and the gate line. A driving circuit of the LCD apparatus includes a data driving circuit for providing the data lines with data signals and a gate driving circuit for providing the gate lines panel with a scan pulse. In addition, a de-multiplexer circuit is disposed between the data driving circuit and the data lines. The de-multiplexer circuit divides one output signal of the data driving circuit to provide plural data lines with the divided output signal. Since the number of output channels of the data driving circuit is reduced by the de-multiplexer circuit, the data driving circuit may be simplified and the number of data input terminals of the LCD panel may be decreased.

FIG. 1 is a plan view showing an active matrix type LCD apparatus.

Referring to FIG. 1, an LCD apparatus includes an LCD panel 13, a data driving circuit 11, a de-multiplexer circuit 14, and a gate driving circuit 12. The LCD panel 13 includes m data lines DL1 to DLm, n gate lines GL1 to GLn, and a plurality of pixel driving TFTs 16 that are formed at a crossing area of the data lines DL1 to DLm and the gate lines GL1 to GLn, where m and n are natural numbers. The de-multiplexer circuit 14 is disposed between the data driving circuit 11, the gate lines GL1 to GLn, and the data lines DL1 to DLm of the LCD panel 13. The gate driving circuit 12 sequentially provides the gate lines GL1 to GLn with a plurality of scan pulses.

The pixel driving TFT 16 provides a pixel electrode 15 of a liquid crystal cell with data signals provided from the data lines D1 to DLm in response to a scanning signal provided from the gate lines GL1 to GLn. In order to realize the above, gate electrodes (not shown) of the pixel driving TFTs 16 are connected to corresponding gate lines GL1 to GLn. Similarly, source electrodes (not shown) of the pixel driving TFTs 16 are connected to corresponding data lines DL1 to DLm, and drain electrodes (not shown) of the pixel driving TFTs 16 are connected to pixel electrodes 15 of the liquid crystal cell.

The data driving circuit 11 converts digital video data into an analog gamma compensation voltage and temporally divides data signals corresponding to one frame of video data to provide m/2 source lines SL1 to SLm/2 with the divided data signal.

The de-multiplexer circuit 14 is disposed between the data driving circuit 11, the gate lines GL1 to GLn, and the data lines DL1 to DLm. The number of the de-multiplexer circuits 14 may be m/2 to be disposed in parallel with each other. Each of the de-multiplexer circuits 14 includes a first de-multiplexer TFT (hereinafter, "MUX TFT") MT1 and a second MUX TFT MT2 to divide a data voltage provided from one source line and to supply the divided data voltage to two data lines DL1 and DL2, respectively. The first MUX TFT MT1 and the second MUX TFT MT2 temporally divide the data voltage inputted through one source line SL1 and supply the divided data voltage to two data lines DL1 and DL2, in response to a first control signal $\phi$1 and a second control signal $\phi$2, which are different from each other. The first MUX TFT MT1 and the second MUX TFT MT2 are supplied with the first control signal $\phi$1 and the second control signal $\phi$2 through a first control signal bus line TG1 and a second control signal bus line TG2, respectively.

The gate driving circuit 12 sequentially provides the gate lines GL1 to GLn with scan pulses by using a shift register and a level shifter.

FIG. 2 shows waveform diagrams of control signals and scan pulses that are provided to a de-multiplexer circuit and pixel driving TFT of FIG. 1. For example, FIG. 2 shows first and second control signals $\phi$1 and $\phi$2 from the data driving circuit 11 as well as scan pulses SP1 to SPn from the gate driving circuit 12 that are provided to the de-multiplexer circuit 14.

Referring to FIG. 2, a plurality of scan pulses SP1, SP2, SP3, . . . , SPn has a level of a gate high voltage Vgh generated during one horizontal interval 1H and a level of a gate low voltage Vgl generated during the remaining period that is outside of the one horizontal interval 1H. Since one frame interval corresponds to a time including multiple, for example, hundreds, of horizontal intervals, a duty ratio of a scan pulse, e.g., SP1, may be one out of a total of several hundreds of horizontal intervals.

The first control signal $\phi$1 and the second control signal $\phi$2 of the de-multiplexer circuit 14 are generated at the gate high voltage Vgh during about (i.e., exactly, slightly less than, or slightly greater than) half of a horizontal interval for every horizontal interval. The first control signal $\phi$1 and the second control signal $\phi$2 are generated every horizontal interval 1H so that the duty ratios of the control first signal $\phi$1 and the second control signal $\phi$2 may be about one-half.

The first and second MUX TFTs MT1 and MT2 of the de-multiplexer circuit 14 and the pixel driving TFT may be simultaneously and directly formed on a glass substrate of the LCD panel 13. Swing widths, i.e., the voltage difference between ON and OFF states, of the first and second MUX TFTs MT1 and MT2 and the pixel driving TFT 16 may be equal to each other. For example, the swing widths of the first and second MUX TFTs MT1 and MT2 and the pixel driving TFT 16 may be between a gate high voltage Vgh and a gate low voltage Vgl.

However, when the same polarity of gate voltages is applied to the first and second MUX TFTs MT1 and MT2 for a long time, a positive gate-bias stress or a negative gate-bias stress may be generated in the first and second MUX TFTs MT1 and MT2. Thus, a variation of operating characteristics or deterioration may be generated in comparison with the pixel driving TFT 16 because the gate electrodes of the first and second MUX TFTs MT1 and MT2 require a long gate voltage applying time (i.e., a total applying time) in comparison with the pixel driving TFT 16 of FIG. 1. In order to address this issue, the first and second MUX TFTs MT1 and MT2 may be formed in a larger size. Forming the first and second MUX TFTs MT1 and MT2 of the de-multiplexer circuit 14 of an amorphous silicon (a-Si), the first and second MUX TFTs MT1 and MT2 may be a larger size due to the semiconductor layer characteristics of amorphous silicon (a-Si). A data voltage charged in the pixel electrode 15 may be affected by an increased parasitic capacitance generated at the MUX TFTs MT1 and MT2 that are formed in a larger size, which might produce a distortion of a data signal. Due to the distortion of the data signal, a green pixel and a red pixel may appear with higher luminance than a blue pixel.

SUMMARY OF THE INVENTION

Exemplary embodiments of the present invention provide a liquid crystal display (LCD) apparatus capable of minimizing vertical line defects, which may be generated when a de-multiplexer circuit is used, and reducing the number of output channels of a data driving circuit formed of amorphous silicon (a-Si).

Exemplary embodiments of the present invention also provide an LCD apparatus and a method of driving the LCD apparatus where a de-multiplexer circuit is disposed between a data driving circuit and gate and data lines so that the number of signal wirings may be minimized and a circuit configuration may be simplified. Moreover, an ON-OFF sequence in accordance with a color filter corresponding to a data line is controlled by a control signal for controlling a MUX TFT so that vertical line defects may be minimized.

Additional features of the invention will be set forth in the description which follows and, in part, will be apparent from the description or may be learned by practice of the invention.

An exemplary embodiment of the present invention discloses a liquid crystal display (LCD) apparatus that comprises a plurality of data lines to receive data voltages from a plurality of source lines; a first control signal bus line to receive a first control signal; a second control signal bus line to receive a second control signal lagging behind the first control signal; a de-multiplexer circuit comprising a first switching element and a second switching element, the first switching element to switch a first current path between a first source line and a first data line in response to the first control signal, and the second switching element to switch a second current path between the first source line and a second data line in response to the second control signal; and a pixel part. The pixel part comprises a first pixel connected to the first control signal bus line and corresponding to a first color filter; a second pixel connected to the second control signal bus line and corresponding to a second color filter; and a third pixel corresponding to a third color filter, wherein the third pixels are alternately connected to the first control signal bus line and the second control signal bus line.

An exemplary embodiment of the present invention also discloses a method of driving a liquid crystal display (LCD) apparatus that comprises receiving data voltages from a plurality of source lines to provide the data voltages to a de-multiplexer circuit connected to a plurality of data lines; delivering a first control signal from a first control signal bus line to the de-multiplexer circuit; delivering a second control signal from a second control signal bus line to the de-multiplexer circuit, the second control signal lagging behind the first control signal; switching, by a first switching element of the de-multiplexer circuit, a first current path between a first source line and a first data line in response to the first control signal; switching, by a second switching element of the de-multiplexer circuit, a second current path between the first source line and a second data line in response to the second control signal; delivering respective data signals to respective first pixels in response to the second control signal; delivering respective data signals to respective second pixels in response to the first control signal; and delivering respective data signals to a first group of third pixels in response to the first control signal, and delivering respective data signals to a second group of third pixels in response to the second control signal, wherein the first pixels corresponds to a first color filter, the second pixels corresponds to a second color filter, and the first group of third pixels and the second group of third pixels correspond to a third color filter.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
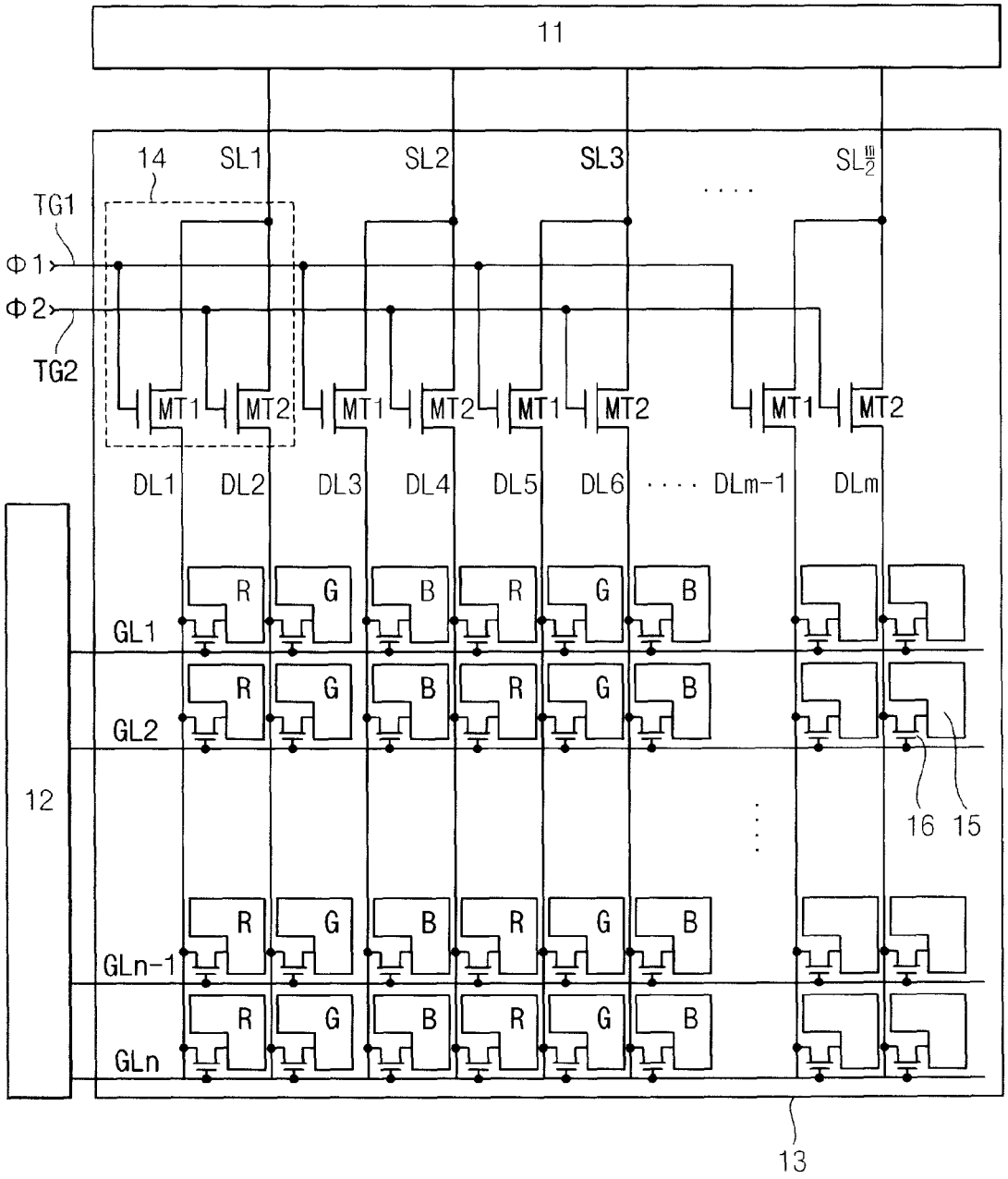
FIG. 1 (PRIOR ART)
FIG. 1 is a plan view showing a liquid crystal display (LCD) apparatus.
Figure 2:
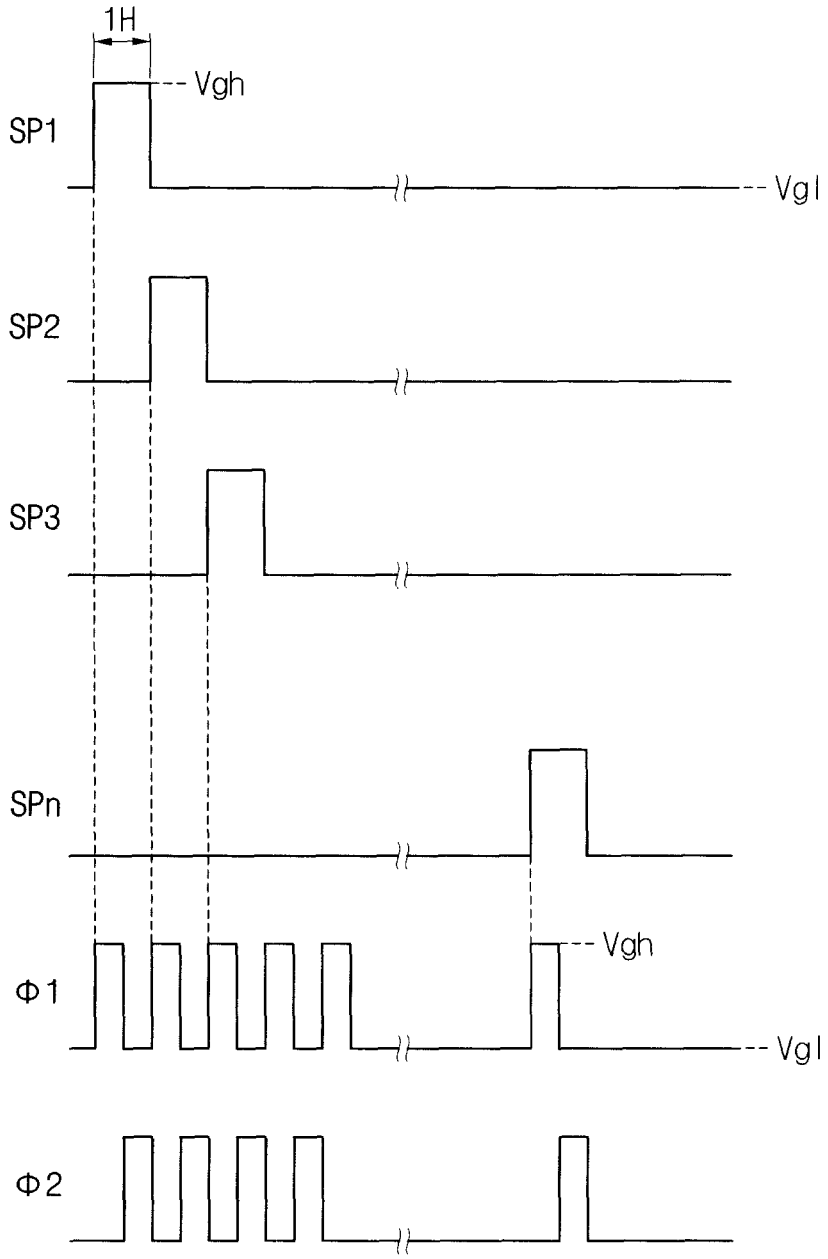
FIG. 2 (PRIOR ART)
FIG. 2 shows waveform diagrams of scan pulses and a first control signal and a second control signal that are provided to a de-multiplexer circuit of FIG. 1.

The invention is described more fully hereinafter with reference to the accompanying drawings in which embodiments of the invention are shown. This invention may, however, be embodied in many different forms and should not be construed as limited to the embodiments set forth herein. Rather, these embodiments are provided so that this disclosure is thorough and will fully convey the scope of the invention to those skilled in the art. In the drawings, the sizes and relative sizes of layers and regions may be exaggerated for clarity. Like reference numerals in the drawings denote like elements.

It will be understood that when an element or layer is referred to as being "on," "connected to" or "coupled to" another element or layer, it can be directly on, directly connected to, or directly coupled to the other element or layer, or intervening elements or layers may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms such as first, second, and third may be used herein to describe various elements, components, regions, layers, and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of the invention.

Spatially relative terms, such as "beneath," "below," "lower," "above," "upper" and the like may be used herein for ease of description to describe one element or feature's relationship to another element(s) or feature(s) as shown in the figures. It will be understood that the spatially relative terms are intended to encompass different orientations of the device in use or operation in addition to the orientation shown in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing exemplary embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional views that schematically show idealized exemplary embodiments (and intermediate structures) of the present invention. As such, variations from the shapes of the figures as a result, for example, of manufacturing techniques and/or tolerances, are to be expected. Thus, exemplary embodiments of the present invention should not be construed as limited to the particular shapes of regions shown herein but are to include deviations in shapes that result, for example, from manufacturing. For example, an implanted region shown as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions shown in the figures are schematic in nature and their shapes are not intended to show the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Figure 3:
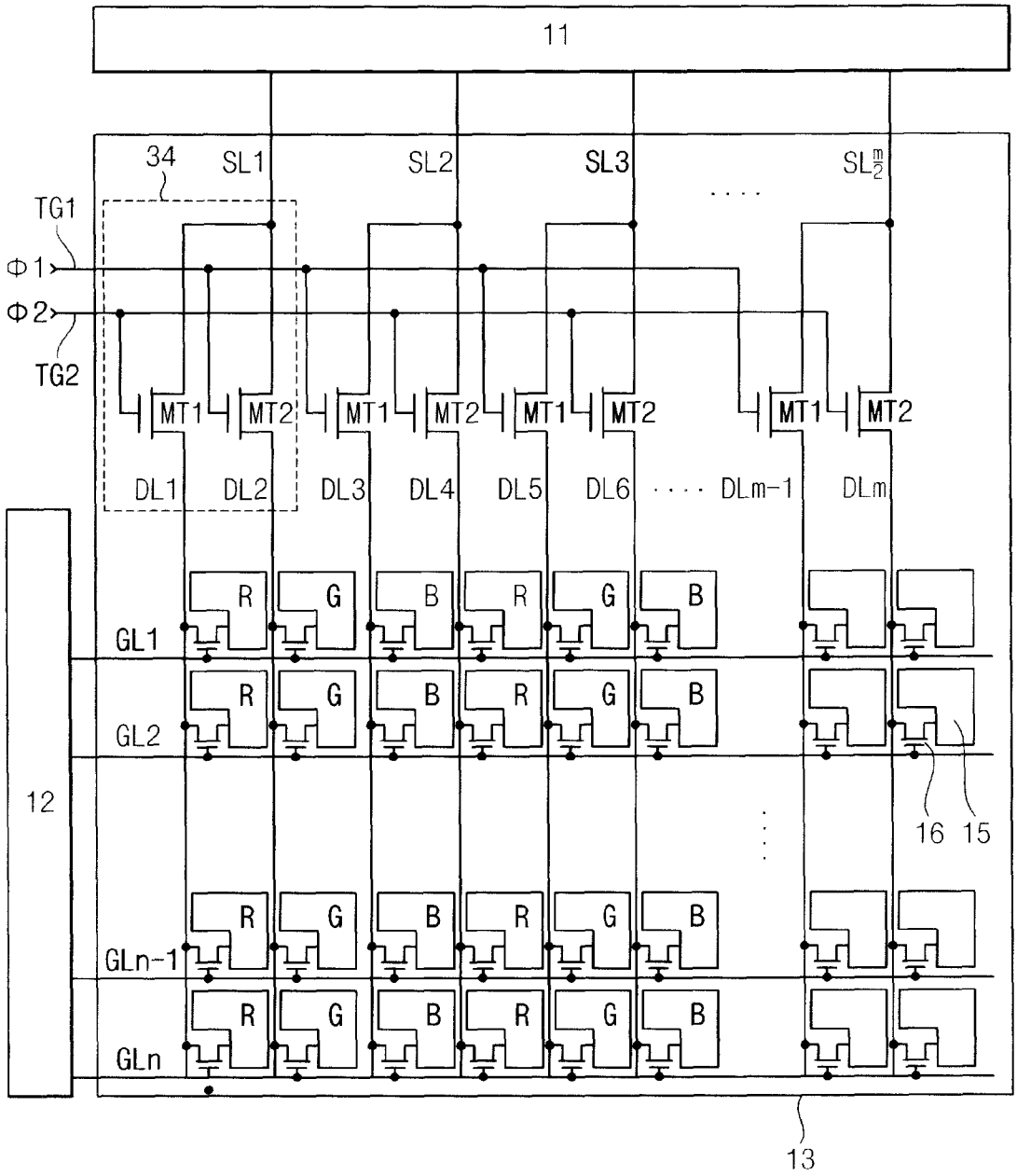
FIG. 3 is a plan view showing an LCD apparatus according to an exemplary embodiment of the present invention.

FIG. 3 is a plan view showing a liquid crystal display (LCD) apparatus according to an exemplary embodiment of the present invention.

Referring to FIG. 3, the LCD apparatus of an active matrix type is substantially the same as the LCD apparatus of FIG. 1 except for at least a connection configuration of the de-multiplexer circuit 34 shown in FIG. 1.

In FIG. 1, a first MUX TFT MT1 is connected to a first control signal bus line TG1, and a second MUX TFT MT2 is connected to a second control signal bus line TG2. However, in FIG. 3, the first and second MUX TFTs MT1 and MT2 are connected to the first control signal bus line TG1 and the second control signal bus line TG2 according to a color of the pixel to which the first and second MUX TFTs MT1 and MT2 are connected.

In FIG. 3, the LCD apparatus according to an exemplary embodiment of the present invention includes a 1:2 de-multiplexer circuit 34. A green pixel G is connected to a first control signal bus line TG1 receiving a first control signal $\phi$1, and a red pixel R is connected to a second control signal bus line TG2 receiving a second control signal $\phi$2. A blue pixel B is alternately connected to the first control signal bus line TG1 and the second control signal bus line TG2 to alternately receive the first control signal $\phi$1 and the second control signal $\phi$2. According to an exemplary embodiment of the present invention, the duty ratios of the first control signal $\phi$1 and the second control signal $\phi$2 respectively applied to the first and second MUX TFTs MT1 and MT2 are generated every one horizontal interval period to be about ½.

Figure 4:
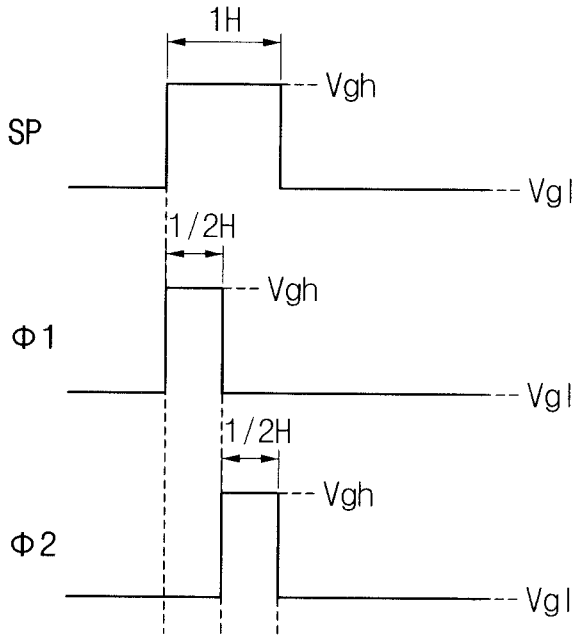
FIG. 4 shows waveform diagrams of a scan pulse and control signals provided to a de-multiplexer circuit of FIG. 3.

FIG. 4 shows waveform diagrams of a scan pulse and control signals provided to a de-multiplexer circuit of FIG. 3.

Referring to FIG. 4, when an ON voltage of amplitude Vgh of the first control signal $\phi$1 is applied to the de-multiplexer circuit for a first half-interval (½H) of one horizontal period 1H and an ON voltage of amplitude Vgh of the second control signal $\phi$2 is applied to the de-multiplexer circuit for a second half-interval (½H) (which temporally follows after the first half-interval) of one horizontal period 1H, the green pixel G receives a data voltage for the first half-interval (½H), and the red pixel R receives a data voltage for the second half-interval (½H), respectively. Blue pixels B connected to the first control signal bus line TG1 receive a data voltage for the first half-interval (½H), and blue pixels B connected to the second control signal bus line TG2 receive a data voltage for the second half-interval (½H). Thus, a distortion of the data voltages applied to the pixels may appear at the blue pixel B.

Since human eyes have different sensitivities to green, red, and blue colors with the order of sensitivity decreasing in the order of green, red, and blue, the luminance of a blue color may be sensed lower than corresponding luminance of red and green colors. A distortion of a data voltage applied to a pixel due to a difference between the first control signal $\phi$1 and the second control signal $\phi$2 may be incident at the blue pixels B thereby creating color sensory differences between pixels so that vertical line defects may appear. However, the 1:2 de-multiplexer circuit may mitigate the color sensory differences attending the blue pixels B.

As described above, when a sequence of applying the first control signal $\phi$1 and the second control signal $\phi$2 is exchanged between the first control signal $\phi$1 and the second signal $\phi$2 to minimize the color sensory difference, a sequence of turning on a red pixel R and a green pixel G is correspondingly exchanged between the red pixel R and the green pixel G. Further, a sequence of turning on a blue pixel B is also different so that the vertical line defects may be minimized. To alleviate the vertical line defects, the red pixel R receives a data voltage for the first half-interval (½H) and the green pixel G receives a data voltage for the second half-interval (½H). Accordingly, as shown in FIG. 3, a first half of the blue pixels B receives a data voltage for the first half-interval (½H), and a second half of the blue pixel B receives a data voltage for the second half-interval (½H). The first half of the blue pixels B and the second half of the blue pixels B are alternately arranged in columns among the red pixels R and the green pixels B.

The foregoing is illustrative of the present invention and is not to be construed as limiting thereof. Although exemplary embodiments of the present invention have been described, those skilled in the art appreciate that many modifications and variations can be made in the present invention without departing from the spirit or scope of the invention. Thus, it is intended that the present invention covers the modifications and variations of this invention provided they come within the scope of the appended claims and their equivalents.

What is claimed is:

1. A method of driving a liquid crystal display (LCD) apparatus, comprising:

receiving data voltages from a plurality of source lines to provide the data voltages to a de-multiplexer circuit connected to a plurality of data lines;

delivering a first control signal from a first control signal bus line to the de-multiplexer circuit;

delivering a second control signal from a second control signal bus line to the de-multiplexer circuit, the second control signal lagging behind the first control signal;

switching, by a first switching element of the de-multiplexer circuit, a first current path between a first source line and a first data line in response to the first control signal;

switching, by a second switching element of the de-multiplexer circuit, a second current path between the first source line and a second data line in response to the second control signal;

delivering respective data signals to respective first pixels in response to the second control signal;

delivering respective data signals to respective second pixels in response to the first control signal; and delivering respective data signals to a first group of third pixels in response to the first control signal, and delivering respective data signals to a second group of third pixels in response to the second control signal, wherein the first pixels corresponds to a first color filter, the second pixels corresponds to a second color filter, and the first group of third pixels and the second group of third pixels correspond to a third color filter.

2. The method of claim 1, further comprising delivering a plurality of gate voltages from a plurality of gate lines connected to the pixel part, wherein the gate voltages maintain a high voltage during one scan period.

3. The method of claim 2, wherein the first pixels receive their data signals during a first half-interval of the one scan period, and the second pixels receive their data signal during a second half-interval of the one scan period.

4. The method of claim 3, wherein the third color filter is a blue color filter, and the third pixel is a blue pixel.

5. The method of claim 4, wherein the first color filter is green color filter, the first pixel is a green pixel, the second color filter is a red color filter, and the second pixel is a red pixel.

6. The method of claim 4, wherein the first color filter is a red color filter, the first pixel is a red pixel, the second color filter is a green color filter, and the second pixel is a green pixel.

7. The method of claim 1, wherein a ratio of the number of input terminals to output terminals of the de-multiplexer circuit is 1:2.

8. The method of claim 1, wherein the first switching element and the second switching element each comprise a channel comprising amorphous silicon (a-Si).

9. A liquid crystal display (LCD) apparatus, comprising:

a plurality of data lines to receive data voltages from a plurality of source lines;

a first control signal bus line to receive a first control signal;

a second control signal bus line to receive a second control signal lagging behind the first control signal;

a de-multiplexer circuit comprising a first switching element and a second switching element, the first switching element to switch a first current path between a first source line and a first data line in response to the first control signal, and the second switching element to switch a second current path between the first source line and a second data line in response to the second control signal; and a pixel part comprising:

a first pixel connected to the first control signal bus line and corresponding to a first color filter;

a second pixel connected to the second control signal bus line and corresponding to a second color filter; and a third pixel corresponding to a third color filter, wherein the third pixels are alternately connected to the first control signal bus line and the second control signal bus line.

10. The LCD apparatus of claim 9, wherein a ratio of the number of input terminals to output terminals of the de-multiplexer circuit is 1:2.

11. The LCD apparatus of claim 9, wherein the first switching element and the second switching element each comprise a channel comprising amorphous silicon (a-Si).

12. The LCD apparatus of claim 9, wherein the third color filter is a blue color filter, and the third pixel is a blue pixel.

13. The LCD apparatus of claim 9, wherein the first color filter is a green color filter, the first pixel is a green pixel, the second color filter is a red color filter, and the second pixel is a red pixel.

14. The LCD apparatus of claim 9, wherein the first color filter is a red color filter, the first pixel is a red pixel, the second color filter is a green color filter, and the second pixel is a green pixel.

* * * * *